United States Patent [19]

Hahn

[11] 3,985,384

[45] Oct. 12, 1976

[54] HYDRAULIC APPARATUS FOR GRAB DEVICE

[75] Inventor: Oscar W. Hahn, Houston, Tex.

[73] Assignee: McGinnes Manufacturing Company

[22] Filed: Sept. 29, 1975

[21] Appl. No.: 617,990

[52] U.S. Cl. ..... 294/88; 37/183 R; 214/147 G; 214/656; 294/70

[51] Int. Cl.[2] ..... B66C 3/16

[58] Field of Search ..... 294/68–71, 294/88, 106; 37/182, 183 R, 184–188, DIG. 7; 91/16; 214/147 G, 656, 657

[56] References Cited

UNITED STATES PATENTS

| | | | |
|---|---|---|---|
| 2,557,575 | 6/1951 | Simanek | 37/184 |
| 3,479,077 | 11/1969 | Martin et al. | 294/70 |
| 3,574,387 | 4/1971 | Hahn | 294/88 |

*Primary Examiner*—Johnny D. Cherry
*Attorney, Agent, or Firm*—Pravel & Wilson

[57] ABSTRACT

A new and improved apparatus for a grapple or clam shell bucket having a plurality of pivoted tines or bucket elements which are actuated to a closed or holding position by a first predetermined hydraulic pressure and which are held in closed position by a second predetermined pressure, and wherein the second predetermined pressure has a value lower than the first predetermined pressure to provide sufficient flexibility to a hydraulic hose supplying the hydraulic pressures to facilitate reeling the hose while maintaining the grapple or clam shell bucket in closed position.

16 Claims, 3 Drawing Figures

HYDRAULIC APPARATUS FOR GRAB DEVICE

BACKGROUND OF THE INVENTION

This invention relates generally to the field of grapple or clam shell buckets and more particularly to a hydraulic apparatus for actuating the power assembly of the grappler or clam shell bucket to a closed position.

The need for hydraulically actuated power assemblies for grapples and/or clam shell buckets (hereinafter generically referred as to grab devices) is found in many applications. Hydraulically actuated grab devices make it readily possible to change a grab device on a crane to another size or type on that same crane without the difficulties involved in trying to change the cable system on a crane that is actuated to open and closed positions with a multicable sheave assembly. They also provide the advatages over a cable system of more digging or closing power per pound of the grab weight, the grab is held positively open as well as positively closed and less operating expertise is required. These hydraulically actuated grab devices, however, have resulted in addtional problems. For example, with double or multiple hose systems, the hoses may get tangled with each other as the grab swings, turns and twists in use, and the hoses may not be satisfactorily reeled together because of their odd circular shape when fastened to each other. Additionally, the extra hose or hoses may increase the cost thereof, as well as the weight which may become a serious obstacle in large installations. A single hydraulic hose from the grab bucket to a crane or other location of hydraulic power has been used for connecting hydraulic power to the grab as shown in U.S. Pat. No. 3,574,387 by the same inventor as this case, and which patent disclosure is incorporated herein by reference. However, the hydraulic pressure which is sufficient to effect closing of, for instance, a clam shell bucket for picking up a load causes such stiffness of the otherwise flexible hydraulic hose supplying the hydraulic pressure that it becomes difficult to coil the hose on a reel or the like when the bucket is lifted with the load.

This invention offers a new and improved hydraulic apparatus which allows the hydraulic supply hose or hoses to remain sufficiently flexible so that the hose or hoses may be readily wound on a reel or otherwise kept from tangling or being damaged.

SUMMARY OF THE INVENTION

The present invention relates to an apparatus and method for operating a power assembly on a clam shell bucket or other grab device wherein the pivoted tines or grab elements of the bucket are actuated to a closed or grabbing position by a hydraulic hose to the buckets providing a first predetermined hydraulic pressure, and are maintained in the closed position by a second predetermined hydraulic pressure. The second predetermined pressure has a value that provides sufficient flexibility of the hose extending to the bucket to enable winding the hose on a storage reel on the crane while at the same time providing adequate hydraulic pressure to maintain the bucket or grab in the closed position with the load therein.

DESCRIPTION OF THE PREFERRED EMBODIMENTS

Figure 1:
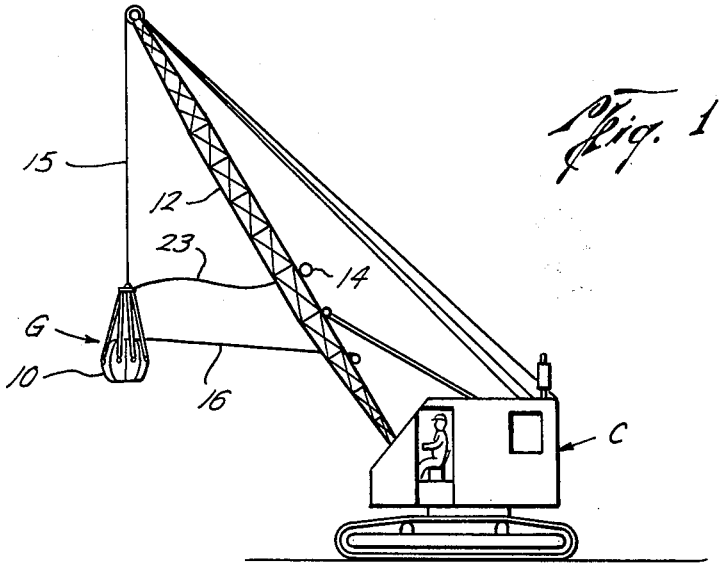
FIG. 1 is an elevation illustrating the present invention on a typical crane.
Figure 2:
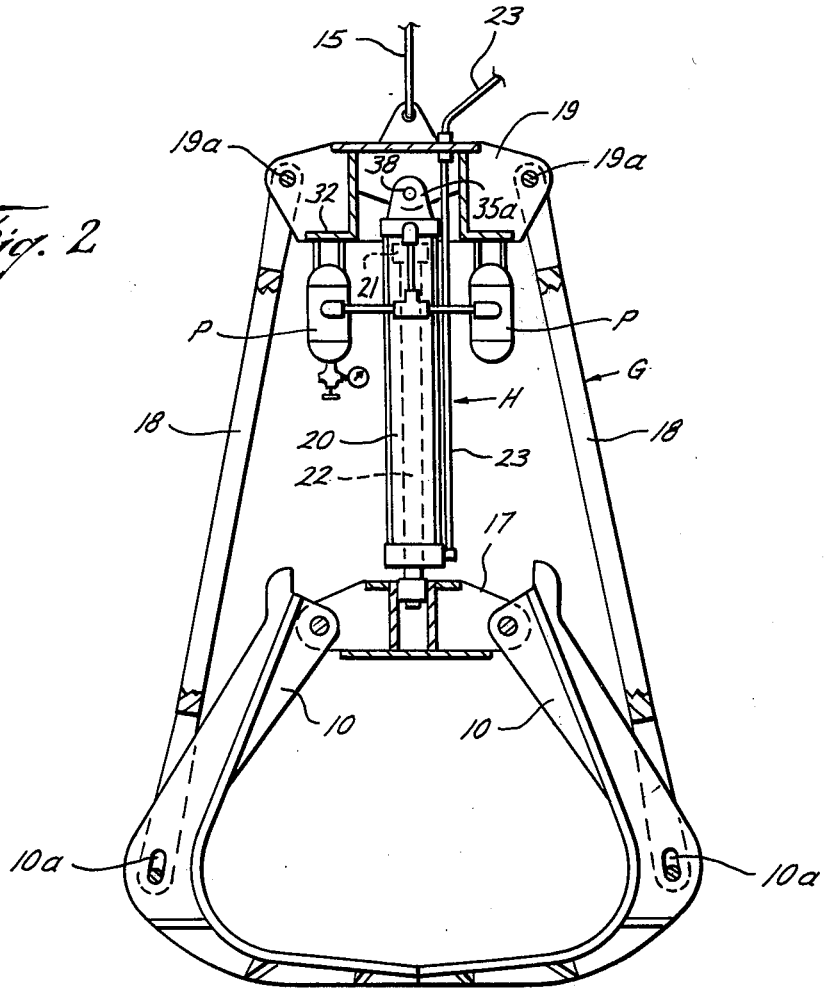
FIG. 2 is a vertical section view of the grab of FIG. 1 with the tines in the closed or the grabbing position.

In the drawings, the letter G designates generally a grapple which is preferably used as shown in FIG. 1 with a crane C of conventional construction, or any other suitable operating equipment. A clam shell bucket or other similar grab device could also be used in place of the grapple. As will be explained in detail, the opening and closing of the tines or grapling elements 10 of the grapple G is accomplished with a unique hydraulic apparatus which operates a power assembly which as shown in FIG. 2 includes a hydraulic means H having a single hose 23 extending from the grapple G to the boom 12 or other part of the crane C. In the usual situation the hose 23 extends to a conventional reel 14 which is mounted on the boom 12 and which extends to the crane C in a known manner for raising and lowering the grapple G. A guideline or cable 16 is connected from the boom 12 to the grapple G to prevent undesired swinging or shifting of the grapple G when in use, as in customary with the type of grapple illustrated therein. The grapple line 16 is formed of wire or wire rope so that it can take any strain exerted by the movements of the grapple G with respect to the boom 12 rather than subjecting the hydraulic line 23 to any such forces.

Considering the grapple G of this invention more in detail reference is made to FIG. 2. The grapple G typically may have eight tines 10 although the particular number may be varied, depending upon the size of the grapple G and other factors which are present in the particular insulation. When the tines 10 are in the closed position illustrated in FIG. 2, the edges of the tines 10 contact each other or are sufficiently close to each other so that together such tines form a bucket.

The tines 10 are pivotally connected to a hinge section 17. Arms 18 are pivotally connected to the tines with a lost motion pivot slot means 10*a*. The other ends of the arms 18 are pivotally connected to a head section 19 with pivot pins 19*a*. A power means H, which is preferably hydraulic, is connected between the head section 19 and the hinge section 17. Such power means H includes a cylinder 20 which is pivotally connected at its upper end to the head section 19 by any suitable means. Piston 21 is slidably disposed within the cylinder 20, and has a piston stem 22 extending downwardly therefrom and through a sealed opening (not shown) in the lower end of the cylinder 20. The piston stem 22 is connected to the hinge section 17 in a known manner. Reference is made to U.S. Pat. No. 3,574,387 for further structural and operating details of a grappling device on which the hydraulic apparatus of this invention may be used.

Figure 3:
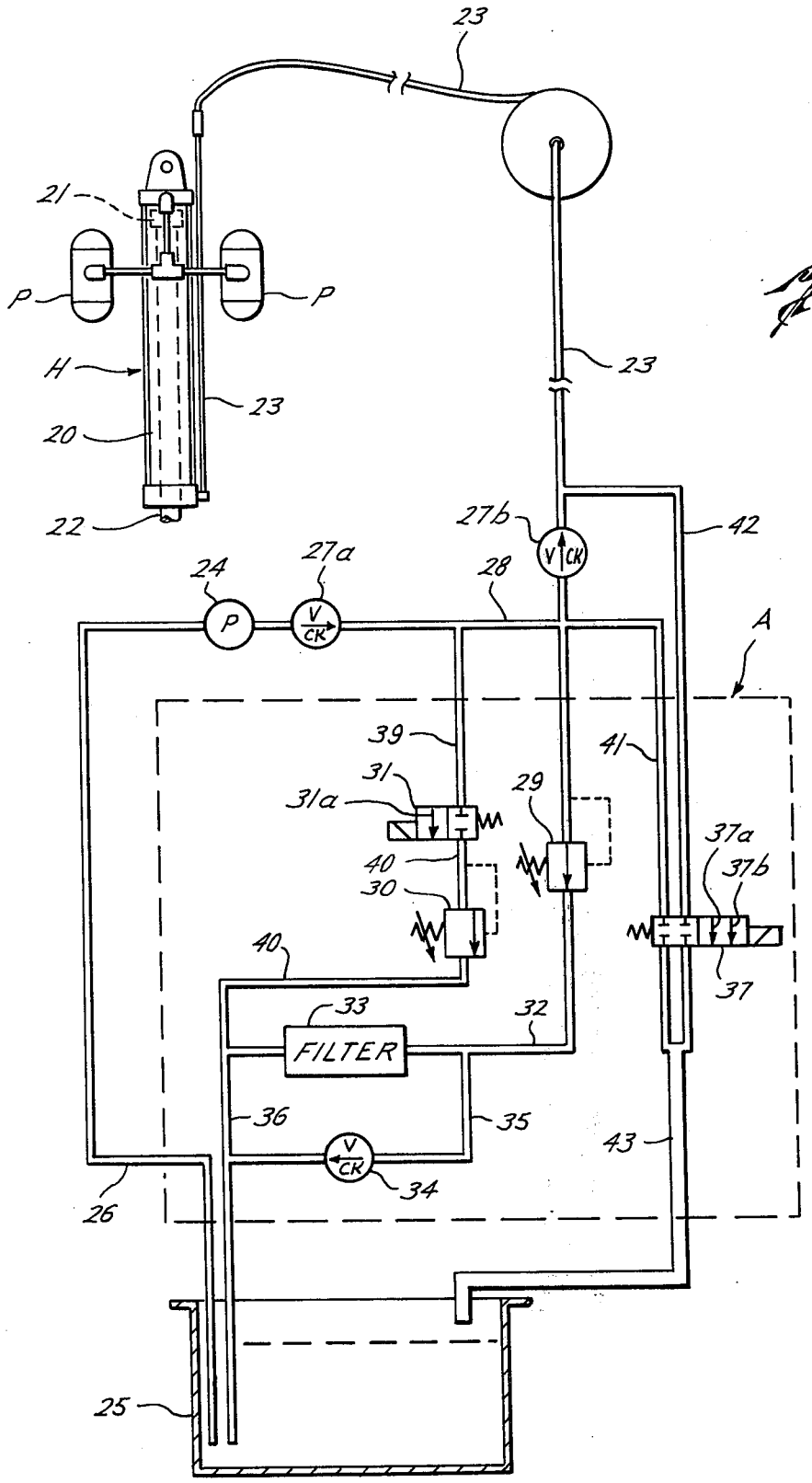
FIG. 3 is a schematic view of the hydraulic apparatus of the present invention.

Hydraulic fluid is introduced into the cylinder 20 below the piston 21 by a hose or supply line 23. The hose 23 is in turn connected to a source of hydraulic fluid in an apparatus such as illustrated in FIG. 3 of the drawing, which will be described in detail hereafter. On the upper side of the piston 21, is mounted a compressed gas means which includes one or more pressure tanks P which are connected to the inlet of the upper end of the cylinder. Gas such as nitrogen or other inert gas is placed in the tank or tanks T. When the piston 21 is in its extended position (not shown), the pressure in the tanks P is in its lowest amount, but when the piston 21 is moved upwardly by the hydraulic pressure introduced through the supply line 23 from the hydraulic apparatus A, the gas within the cylinder 20 above the piston 21, and thus in the tanks P is compressed to a greater extent until the maximum compression is reached when the piston 21 has moved to its uppermost position with the tines 10 in the closed or grappling position of FIG. 2.

In the drawing, the hydraulic apparatus is schematically illustrated as generally designated with the letter A. Such apparatus includes a hydraulic circuit which may be used to operate a clam shell bucket such as shown in U.S. Pat. No. 3,574,387, or other similar apparatus, as will be evident to those skilled in the art.

A portion of the hydraulic apparatus A may be located in the cab of the crane or on the grappling device itself, or otherwise disposed for operator control. The hydraulic apparatus is connected to a conventional rotary positive action pump 24 which supplies hydraulic fluid under pressure to the hydraulic cylinder. The pump is connected to a source of hydraulic fluid such as a sump 25 by a conduit 26. Hydraulic fluid flows from the pump through a check valve 27*a* through conduit 28 and check valve 27*b*. The conduit 28 is connected to the supply hose 23 for supplying hydraulic fluid to the hydraulic cylinder.

The pressure in line 28 is normally regulated by a first pressure relief valve 29 which is adjusted to maintain a first predetermined pressure in line 28. By way of example, under usual operating conditions, the first predetermined pressure is approximately 2,000 psi but it may be varied to accommodate other situations requiring less or more pressure. With solenoid operated valves 31 and 37 in the closed positions, only the first pressure relief valve 29 controls pressure in the conduit 28. Fluid in excess of that required to operate the piston 21 will flow through the first pressure relief valve 29 at a pressure above its setting, and such excess fluid flows through conduit 32, filter 33, and conduit 36 to the sump 25. A check valve 34 in bypass conduit 35 allows flow around the filter when the filter is clogged or is otherwise unable to handle all of the flow in line 32.

The above described operation requires that solenoid valve 37, whose operation is hereafter described, be in the closed position. Opening of the solenoid valve 31 allows flow through the conduits 39 and 40, and through a second pressure relief valve 30. The second pressure relief valve 30 is set to open when the pressure in line 28 exceeds a second predetermined value which is lower than the first predetermined value so that the hose may be readily coiled on the reel, as explained hereinafter. Typically, the second predetermined value is in the order of 500 psi but may also be varied so long as the pressure is sufficient to hold the piston 21 in the position shown in FIG. 2 with the tines 10 in the closed position.

Accordingly, when solenoid operated valves 31 and 37 are in their closed positions, the pressure in lines 28 and 23 are at the higher pressure controlled by valve 29, but upon opening of solenoid operated valve 31 by moving same to position the passage 31*a* in communication with line 39, the pressure in lines 28 and 23 are reduced to the second predetermined pressure by reason of the pressure relief through the valve 30.

The first predetermined pressure is set at a value sufficient to operate the grappling elements from the open to the closed position (FIG. 2). It is understood that when the circuit of the present invention is utilized with a clamshell bucket, that the first predetermined pressure is set at a value sufficient to effect complete closing of the bucket. The second predetermined pressure is set at a value which is sufficient to maintain the grappling elements or bucket in the closed position after complete closing of the bucket elements or tines have occurred. Furthermore, the value of the second predetermined pressure is also set to provide suitable flexibility of the supply hose 23 to permit smooth and unrestricted winding of the hose 23 on the reel 14. The second predetermined pressure is preferably the minimum pressure required to maintain the grappling device in the closed position. Accordingly, the supply hose 23 contains fluid at a pressure that is significantly less than the first predetermined pressure and hence remains sufficiently flexible to be wound or coiled on the reel 14. It is understood that the flexible supply hose 23 may be a conventional high pressure hydraulic hose which becomes less flexible as the hydraulic pressure therein is increased particularly from the standpoint of coiling or bending the hose for reeling it.

Solenoid operated valve 37 provides a reutrn flow path, when opened to position the passages 37*a* and 37*b* in alignment with lines 41 and 42, respectively, to release hydraulic pressure from the hydraulic cylinder 20 and enable the pressurized gas in the pressure tank to effect opening of the grappling device as more fully explained in U.S. Pat. No. 3,574,387. Upon operating the valve 37 to the open position, flow from the pump 24 is directed through conduit 41 and conduit 42 to dump line 43 which returns fluid to the sump 25 at essentially atmospheric pressure and without any substantial opposing line pressure.

Solenoid operated valve 31 has a conventional time delay interceptor that holds valve 31 closed long enough to allow complete closure of the grappling device G to the closed position (FIG. 2) with fluid at the first predetermined pressure. After the complete closing of the clamshell bucket and with the load thus confined in the bucket, the time delay interceptor releases automatically to allow solenoid operated valve 31 to open by actuating of its solenoid (typically may occur within the order of 10 seconds) and allow pressure in conduit 28 to drop to the second predetermined pressure that holds the grappling device in the closed position while providing sufficient flexibility of the supply hose 23 for reeling or coiling same.

The operation of the hydraulic apparatus A is preferably effected by an operator in the cab of the crane C (FIG. 1). When it is desired to lower the clamshell bucket G to pick up a load of shell, dirt, or other material, with pump 24 in operation, solenoid operated valve 37 is placed in the open position, if not already in such open position, to allow return of the hydraulic fluid to the sump 25. Accordingly, with valve 37 in the open position, hydraulic fluid of insufficient pressure flows through the supply hose 23 to effect opening of the grappling device so that the bucket elements or tines 10 are spread apart or open for engaging the material to be picked up. With the open grappling device thus at a desired location to grab the load, the operator actuates solenoid valve 37 to move it to its closed position to divert fluid to the hydraulic cylinder 20. The solenoid valve 31 is closed at this time so that the fluid pressure builds up to the relief pressure of valve 29, which is sufficient to operate the grappling device G to its closed position for enclosing the load within the bucket elements 10. After the grappling device has been completely closed, the time delay interceptor causes solenoid valve 31 to open to provide a path for the fluid through the second pressure relief valve 30 to supply fluid at the second predetermined pressure to the hydraulic cylinder 20, which pressure is sufficient to maintain the grappling device in the closed position. Alternately, the valve 31 may be manually moved to the open position for such purpose. The operator may then raise the grappling device by its supporting cable 15 while coiling the supply hose 23 on the reel 14 or similar reel device. The winding of the supply conduit 23 on the reel 14 is facilitated by the flexibility of the supply conduit due to the reduced second predetermined pressure. Dumping of the material from the clamshell bucket or grappling device G is achieved by opening solenoid valve 37 to cause a dumping of the fluid in the system through oversize line 43 to the sump 25, whereby the piston 21 is moved by the gas pressure in tanks P to spread the bucket elements apart.

The operation may of course be repeated as many times as desired.

The foregoing disclosure and description of the invention are illustrative and explanatory thereof, and various changes in the size, shape, and materials as well as in the details of the illustrated construction may be made without departing from the spirit of the invention.

I claim:

1. Apparatus for operating a clamshell bucket having a plurality of bucket elements, hydraulic means for actuating the elements between open and closed positions, a hose means supplying pressurized fluid to and from the apparatus and the hydraulic means, and a reel means for reeling said hose means thereon, the improvement comprising:

hydraulic apparatus for selectively providing pressurized fluid to the hydraulic means;

means with said hydraulic apparatus for regulating flow for providing a first predetermined pressure sufficient to operate the bucket elements from the open to the closed position under loaded conditions;

said flow regulating means providing a second predetermined pressure to said hydraulic means after said bucket elements have been moved from the open to the closed positon; and said second predetermined pressure having a value sufficient to maintain said bucket elements in the closed position while providing sufficient flexibility of the hose means to facilitate said reeling while maintaining said bucket elements in the closed position under loaded conditions.

2. The apparatus as set forth in claim 1, wherein:

the flow regulating means having a first pressure relief valve for providing the first predetermined pressure.

3. The apparatus as set forth in claim 2, wherein:

the flow regulating means having a second pressure relief valve for providing the second predetermined pressure.

4. The apparatus as set forth in claim 1, wherein:

the hydraulic apparatus having control means for controlling flow of pressurized fluid through the flow regulating means to provide the first and second predetermined pressures.

5. The apparatus as set forth in claim 4, wherein:

the control means having solenoid operated valve means for providing controlled flow of the pressurized fluid.

6. The apparatus as set forth in claim 5, wherein:

the flow regulating means includes a first regulting valve for providing the first predetermined pressure.

7. The apparatus as set forth in claim 6, wherein:

the flow regulating means includes a second regulating valve for providing the second predetermined pressure.

8. The apparatus as set forth in claim 7, wherein:

the solenoid operated valve means having a first solenoid operated valve for controlling flow through said second regulating valve.

9. The apparatus as set forth in claim 4, wherein:

the control means having at least two solenoid operated valve means for providing controlled flow of the pressurized fluids.

10. The apparatus as set forth in claim 1, wherein:

the hose means is a single hose connecting to the hydraulic means.

11. The apparatus as set forth in claim 1, wherein:

the second predetermined pressure having a lower value than the value of the first predetermined pressure.

12. A method of operating a clamshell bucket having a plurality of bucket elements operable between open and closed positions by a hydraulic apparatus which actuates a hydraulic means compirising:

supplying a first predetermined pressure from the hydraulic apparatus through a hose means to the hydraulic means;

the first predetermined pressure having a value sufficient to operate the bucket elements from an open to a closed position under loaded conditions;

supplying a second predetermined pressure from the hydraulic apparatus through the hose means to the hydraulic means;

reeling the hose means on a reel means; and the second predetermined pressure having a value to provide sufficient flexibility to the hose means to facilitate the reeling of the hose means on the reel means while maintaining the bucket elements in said closed position under loaded conditions.

13. The method as set forth in claim 12, including:

supplying the predetermined pressures to the hydraulic means through a single hose connected thereto.

14. The method as set forth in claim 12, including:

providing the first and second predetermined pressures with pressure relief valve means.

15. The method as set forth in claim 12, including:

controlling the supplying of the first and second predetermined pressures with solenoid valve means.

16. The method as set forth in claim 12, wherein:

the second predetermined pressure having a lower value than the value of the first predetermined pressure.

* * * * *